US008657070B2

(12) United States Patent
O'Brien et al.

(10) Patent No.: US 8,657,070 B2
(45) Date of Patent: Feb. 25, 2014

(54) LADDER STEP ATTACHMENT DEVICE

(76) Inventors: Richard O'Brien, Oxnard, CA (US); Holly O'Brien, Oxnard, CA (US)

( * ) Notice: Subject to any disclaimer, the term of this patent is extended or adjusted under 35 U.S.C. 154(b) by 229 days.

(21) Appl. No.: 12/960,367

(22) Filed: Dec. 3, 2010

(65) Prior Publication Data

US 2011/0297482 A1 Dec. 8, 2011

Related U.S. Application Data

(63) Continuation-in-part of application No. 11/375,872, filed on Mar. 14, 2006, now abandoned.

(51) Int. Cl.
*E06C 7/00* (2006.01)

(52) U.S. Cl.
USPC ..... 182/120

(58) Field of Classification Search
USPC ..... 182/120
See application file for complete search history.

(56) References Cited

U.S. PATENT DOCUMENTS

| | | | | |
|---|---|---|---|---|
| 335,051 | A | 1/1886 | Ayers | |
| 1,285,817 | A | 11/1918 | Sklar | |
| 1,820,315 | A | 8/1931 | Miller | |
| D157,206 | S | 2/1950 | Ronfeldt | |
| 2,772,927 | A | 12/1956 | Woodward | |
| 3,115,214 | A | 12/1963 | Roberts | |
| 3,294,197 | A | 12/1966 | Kwiatkowski | |
| 3,907,118 | A * | 9/1975 | Pelavin | 211/113 |
| 4,194,714 | A * | 3/1980 | Schultz | 248/308 |
| 4,437,544 | A | 3/1984 | Anderson et al. | |
| 5,052,515 | A | 10/1991 | Nowlan | |
| 5,779,208 | A | 7/1998 | McGraw | |
| 5,975,240 | A | 11/1999 | O'Brien | |
| 6,786,300 | B1 | 9/2004 | Bonifacini | |
| 2004/0163890 | A1 | 8/2004 | Nash | |
| 2004/0164211 | A1 * | 8/2004 | Orona | 248/214 |
| 2008/0100025 | A1 * | 5/2008 | Leitner et al. | 280/166 |

* cited by examiner

*Primary Examiner* — Alvin Chin Shue

(74) *Attorney, Agent, or Firm* — Edwin Tarver; Lauson & Tarver, LLP

(57) ABSTRACT

A ladder step attachment made of a single, unitary piece of extruded aluminum having no moving parts. The attachment has a horizontal standing surface improved with a gripping surface, the standing surface having two notches for engaging the rails of a ladder and extending partially between the ladder rails. A lip connected to the standing surface presents a resilient member to abut the back side of the rung. A substantially tube-shaped support has a tube wall. One part of the tube wall shares a portion of the standing surface and another part of the tube wall engages the ladder's rails. A bend at the top of the rail engaging tube wall separates that portion of the tube wall from a substantially vertical portion of tube wall above the bend to facilitate removal.

10 Claims, 5 Drawing Sheets

LADDER STEP ATTACHMENT DEVICE

This application is a continuation-in-part of application Ser. No. 11/375,872, filed on Mar. 14, 2006 now abandoned.

BACKGROUND

The present invention relates in general to ladder step attachment devices, and more particularly to an improved ladder step attachment device that can be mounted on a conventional extension ladder, providing additional foot support.

Ladder rungs are not sufficiently wide to provide a convenient and comfortable foot support for long periods of time. Painters, contractors, homeowners and others are frequently required to work for extended periods of time standing on the rungs. Ladder-mounted attachment devices aim to provide a platform to increase safety and comfort.

Several ladder step attachment devices are known in the art. For example, U.S. Pub. No. 2004/0163890 to Nash discloses a ladder step platform that can be mounted on any ladder having hollow rungs extending between ladder rails. The device includes a step platform extending between side plates that are positioned on the outside of the ladder rails. The space between the side plates can be adjusted to fit ladders of different width. A support rod, inserts through the hollow rungs, and pivotally supports the ladder step platform with the side plates. A lower adjustable rod abuts the ladder rails such that the step platform extends horizontally beyond the ladder. Unfortunately, the installation means of this device, for example the use of the support and adjustable rods, are inconvenient and difficult to use.

U.S. Pat. No. 5,052,515 to Nowlan discloses a ladder attachment comprising a platform, a vertical support member projecting from one edge of the platform, and two brackets. An upper bracket is intended to engage a rung of the ladder to impart lateral stability to the platform, while a lower bracket is intended to cooperate with a second rung of the ladder to provide lateral and vertical stability to the platform. The need for two rungs for support and the structure of this device, especially the vertical member and the two brackets, makes it bulky and difficult to operate with a single hand.

U.S. Pat. No. 1,820,315 to Miller discloses a ladder step attachment consisting of a step platform connected to a pair of transversely spaced metallic brackets and a transversely extending stop member. The metallic brackets have their upper ends formed to include hooks capable of being inserted over the rungs of the ladder. The horizontal feature of the metallic brackets are connected to the under surface of the step platform. Although the installation procedure appears to be similar, the hooks and the stop member of this device make it ineffective.

U.S. Pat. No. 6,786,300 to Bonifacini discloses a step unit that can be installed on the existing step of a conventional ladder. The unit comprises of a rectangular main body portion with one of its end bent downward and angularly outward with respect to the main body portion and terminates in a short upturned lip. The unit is installed by engaging the upturned lip against the bottom edge of the step and then pivoting the unit downwardly. The lip of the unit is then captured by the bottom edge of the step and the main body portion is supported on top of the step. However, the bent and upturned lip features of this device are different from the lip and the tubular members of the present invention.

Although these devices can be mounted on a ladder to provide additional foot support, they are frequently inconvenient to use, overly complex, or lack stability. Some devices Therefore, it is an object of the present invention is to provide an improved ladder step attachment device that is portable, simple and easy to install and uninstall, and strong enough to withstand the weight of a person. Other objects of the present invention will become better understood with reference to the appended summary, description, claims and illustrations.

SUMMARY

This apparatus can be mounted on a ladder to provide a larger standing area for more comfortable foot support. Overall, the apparatus is characterized by a unitary, single-piece extruded aluminum construction, which lowers manufacturing costs, and avoids the need to assemble multiple parts with fasteners. The shape of the apparatus is characterized by a standing surface adapted to support a person, a lip member adapted to engage a ladder rung, and a support member adapted to brace against the ladder rails adjacent the rung. Tension created between the lip member engaged on the rung, and the support member engaged on the ladder rails holds the apparatus in position.

The standing surface is adapted to present a substantially horizontal standing surface to support a person when the apparatus is installed on a ladder. Preferably the upper surface comprises a non-slip feature for added traction. The standing surface is generally rectangular in top view except for notches designed to accommodate the ladder rails. The lip member is adapted to engage the back of the ladder rung and preferably comprises resilient stoppers, enhancing the ability of the lip member to engage the rung. In another embodiment, the lip member comprises horizontal ridges to keep it in position. The support member is characterized by a modified tube having a tube wall, a portion of which is shared with a portion of the standing surface, and another portion of which is adapted to abut a predetermined length of the ladder rails.

In order to mount the device on a conventional ladder, including an extension ladder, the lip member is brought to bear against a ladder rung, and the support member is disposed against the faces of the side rails of the ladder. With the lip member engaging the back of the rung, and the support member engaging the ladder rails, the standing surface is held in position at a substantially horizontal plane under tension, capable of supporting a person.

DESCRIPTION

Figure 1:
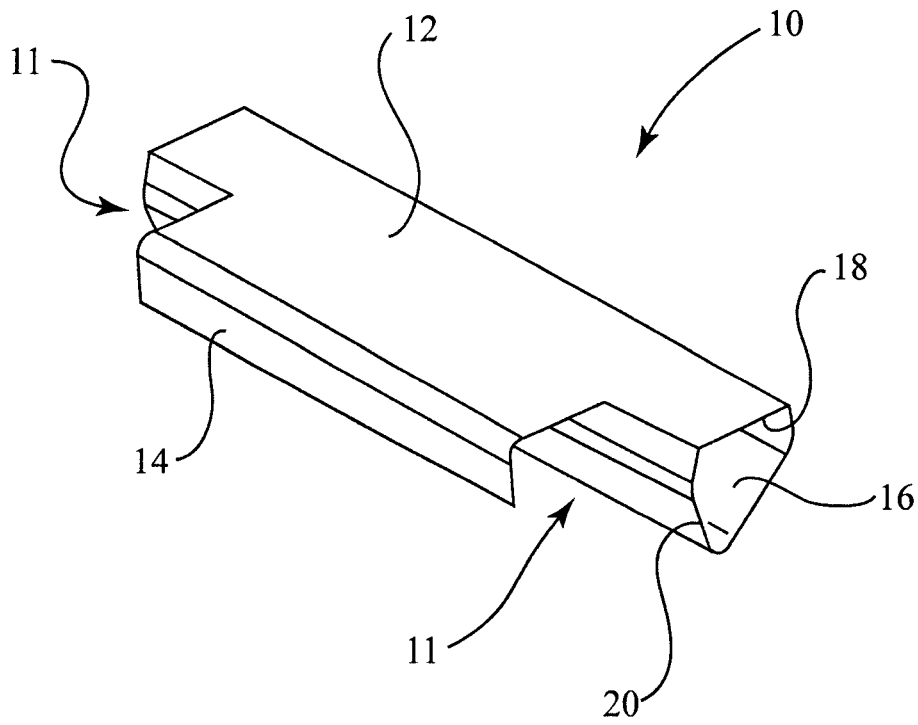
FIG. 1 is a perspective view of a ladder step extension.

Referring to FIG. 1, the ladder step attachment 10 is of unitary, single piece construction and comprises a standing surface 12, a lip member 14 and a support 16. The standing surface 12 is adapted to support a person and presents a substantially horizontal planar surface. The lip member 14 depends from one edge of the standing surface 12, and is adapted to engage a ladder rung. The support member 16 is characterized by a modified tube shaped member. A portion of the standing surface 12 and a portion of the support member 16 share a common wall 18. Another portion of the support member 16 wall is an engaging portion 20, designed to abut the faces of ladder rails. The ladder step attachment 10 also comprises notches 11, permitting its partial insertion between the ladder rails.

Figure 2:
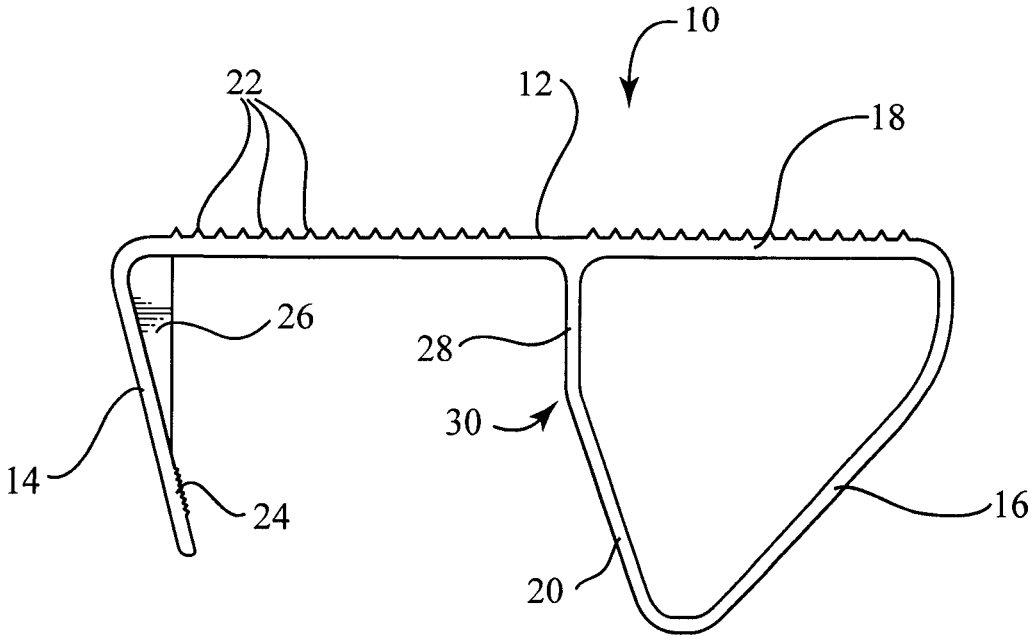
FIG. 2 is a side view of a ladder step extension.

Referring to FIG. 2, one exemplary embodiment of the ladder step attachment 10 is shown in side-view profile. As is shown in this view, the ladder step attachment 10 is preferably made of a single unitary piece. In a preferred embodiment, the ladder step attachment 10 is made of extruded aluminum. Extruded aluminum is preferable because of its relatively low cost and high tensile strength. It is anticipated that alternative materials may be used to construct the apparatus as they become available.

The standing surface 12 comprises a non-slip feature. In one exemplary embodiment, the non-slip feature comprises ridges 22 on the standing surface 12 in parallel to a ladder rung. The ridges 22 facilitate gripping, while allowing any liquid falling on the standing surface 12 to drain off. In a preferred embodiment, the standing surface 12 is sized so that it projects outward beyond the plane of the ladder rails between 2 and 3 inches. It has been observed that this range presents the greatest standing area without presenting an obstacle when a user needs to climb around the ladder step attachment 10. In one embodiment the standing surface extends two and one half (2½) inches from the ladder rails.

The lip member 14 depends from the standing surface 12 in a manner designed to engage the rear of a ladder rung. In one exemplary embodiment, the lip member 14 depends at a seventy-five (75) degree angle from the standing surface 12. In another exemplary embodiment, the lip member 14 extends downward from the standing surface 12 approximately two (2) inches. In yet another exemplary embodiment, the lip member 14 comprises a gripping surface 24, designed to engage a ladder rung to prevent slippage.

Slippage of the lip member 14 is chiefly avoided by the use of at least one resilient stopper 26 disposed on the lip member 14. The resilient stopper 26, made of rubber in one exemplary embodiment, prevent the lip member 14 from moving vertically relative to a ladder rung by engaging the rung under pressure generated by a user's weight. As a user stands on the standing surface 12, downward pressure on the apparatus 10 urges the support member 16 down and away from the rung by virtue of the ladder's angle of lean. This causes the lip member 14 to tightly engage a ladder rung when a person stands on the standing surface 12.

The support member 16 is generally tube shaped. One portion of the support member 16 comprises a common wall 18 shared with the standing surface. Another portion of the support member 16 comprises a flat engaging portion 20, adapted to engage the rails of a ladder. The engaging portion 20, in one preferred embodiment is disposed at an angle twenty (20) degrees from vertical to match the angle of lean of a conventional ladder. With the engaging portion 20 abutting the rails of a ladder, the common wall 18 and the rest of the standing surface 12 are substantially horizontal.

Above the engaging portion 20 of the support member 16 is a non-engaging portion 28. A bend 30 separates the engaging portion 20 and non-engaging portion 28. The purpose of the non-engaging portion 28 and bend 30 is to facilitate removal of the ladder step attachment 10. Without the non-engaging portion 28 and bend 30, downward pressure on the ladder step attachment 10, combined with slight flexing, causes the ladder step attachment 10 to tightly engage a ladder as a person steps off the standing surface, preventing removal.

The remaining portions of the tubular wall of the support member 16, other than the common wall 18, engaging portion 20, and non-engaging portion 28 serve to connect those portions and form the modified tubular shape of the support member 16.

The apparatus having been shown and describe, its use will now be discussed.

Figure 3A:
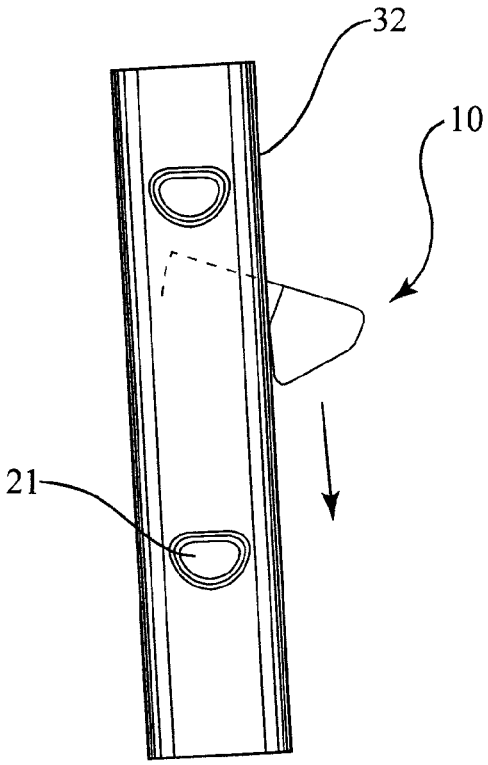
FIGS. 3A and 3B are a side view and perspective view, respectively, of the installation method of a ladder step extension.
Figure 3B:
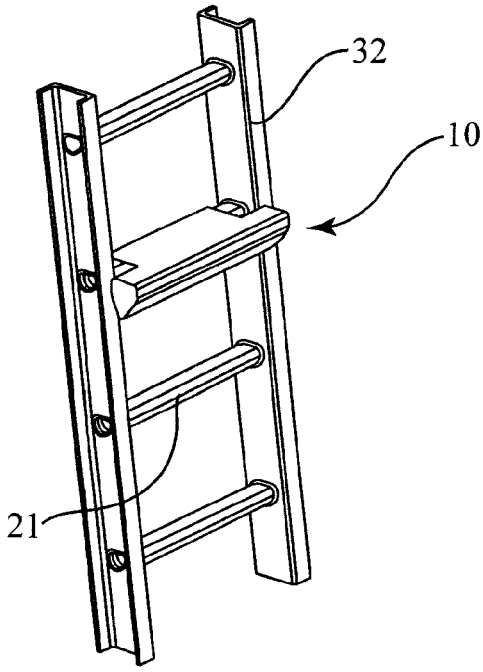
Figure 4:
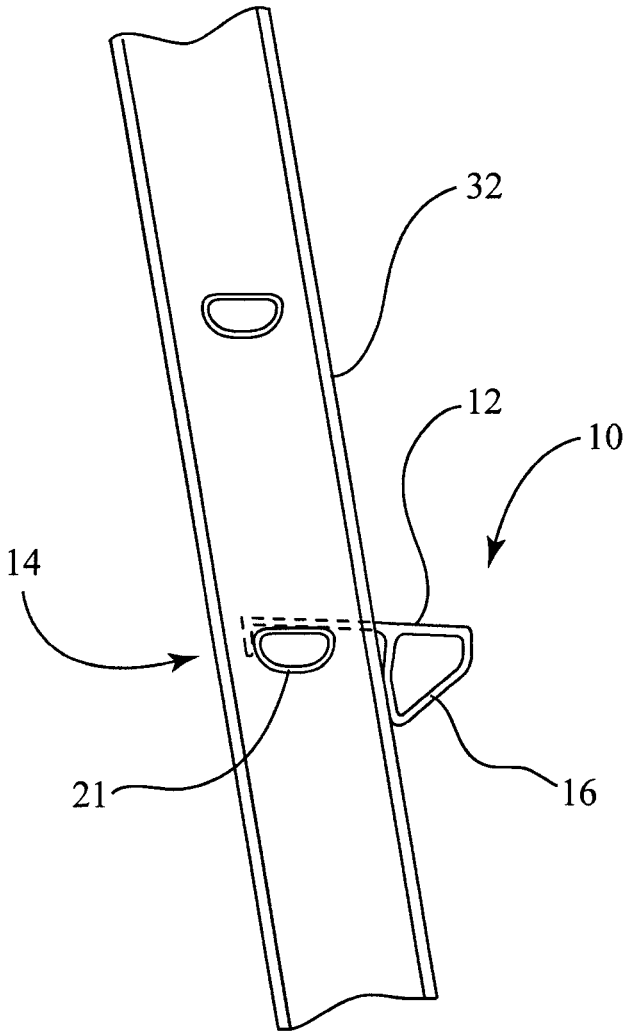
FIG. 4 is a side view of a ladder step extension installed on a ladder
Figure 5:
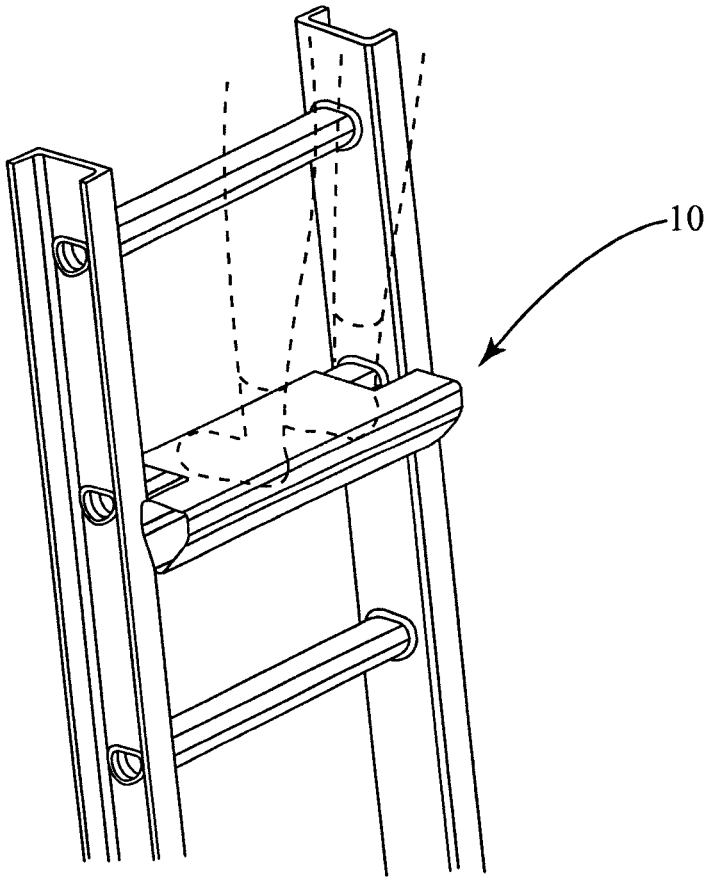
FIG. 5 is a perspective view of a user standing on a ladder step extension

As shown in FIG. 3A, in order to use the ladder step attachment 10, a user places the ladder step attachment 10 against the rails 32 of a ladder. The user then brings the ladder step attachment 10 down to engage a rung 21 of the ladder as shown in FIG. 3B. As FIG. 4 shows, the lip 14 is disposed against the ladder rung, the support member 16 rests against the ladder rails 32 so that the standing surface 12 is horizontal to the ground. A user may then stand on the ladder step attachment 10 as shown in FIG. 5.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A step extension apparatus for affixing to a ladder having rails and rungs, comprising:

a standing surface defining a pair of laterally opposed notches;

a lip comprising at least one resilient stopper adapted to engage a ladder rung;

a support, wherein said support is substantially tube-shaped, having a tube wall, a first common wall area extending downward from said standing surface, a second wall which engages a predetermined length of said rails, said second wall area opposing said lip and extending contiguously between said notches to project laterally beyond said lip, wherein said second wall area includes a bend formed intermediately thereacross between a non-engaging portion extending downward from said standing surface and an engaging portion angled relative to said non-engaging portion and engaging said predetermined length of said rails, the bend defining an angular pivot between said engaging and non-engaging portions maintaining a clearance between said non-engaging portion and said rails to facilitate disengagement from the ladder; and wherein said standing area extends between two (2) and three (3) inches to span said first and second wall areas of said support.

2. The apparatus of claim 1 wherein said apparatus comprises a unitary, single piece construction having no moving parts.

3. The apparatus of claim 1 wherein said apparatus comprises extruded aluminum.

4. The apparatus of claim 1 wherein the standing surface presents a substantially horizontal plane when installed on the ladder.

5. The apparatus of claim 1 wherein said standing surface comprises a gripping surface.

6. The apparatus of claim 1 wherein said standing surface comprises a gripping surface comprising parallel ridges adapted to be disposed parallel to a ladder rung.

7. The apparatus of claim 1 wherein said lip member depends from said standing surface at an angle approximately fifteen (15)degrees from vertical.

8. The apparatus of claim 1 wherein said lip member depends from said standing surface a length of approximately two (2) inches.

9. The apparatus of claim 1 wherein the portion of the second wall area adapted to engage the ladder is approximately twenty (20) degrees from vertical.

10. A ladder step extension apparatus comprising:

a standing surface having two laterally opposed notches to accommodate both rails of a ladder, and a gripping surface;

a lip adapted to engage a rung of said ladder, comprising at least one resilient stopper adapted to engage the back of said rung, said lip depending from said standing surface;

a tube support having a tube wall having a first common wall area extending downward from said standing surface, a second wall area which engages a predetermined length of said both rails, said second wall area opposing said lip and extending contiguously between said notches to project laterally beyond said lip;

wherein said second wall area includes a bend formed intermediately thereacross between a non-engaging portion extending downward from said standing surface and an engaging portion angled relative to said non-engaging portion and engaging said predetermined length of said both rails, the bend defining an angular pivot between said engaging and non-engaging portions maintaining a clearance between said non-engaging portion and said both rails when said engaging portion is engages the rails of the ladder to facilitate disengagement from the ladder; and wherein said standing area extends between two (2) and three (3) inches to span said first and second wall areas of said tube support, and said standing surface is substantially horizontal when said apparatus is installed on a ladder.

* * * * *